US007640774B2

(12) United States Patent
Hashizume et al.

(10) Patent No.: US 7,640,774 B2
(45) Date of Patent: Jan. 5, 2010

(54) WIRE DRAWING MACHINE AND METHOD

(75) Inventors: Michinori Hashizume, Yawata (JP); Jiro Kajino, Neyagawa (JP); Kosuke Takemoto, Kyotanabe (JP); Kaoru Shimuzu, Osaka (JP)

(73) Assignees: ASKK Co., Ltd., Osaka (JP); Factory-Automation Electronics Inc., Osaka (JP)

( * ) Notice: Subject to any disclaimer, the term of this patent is extended or adjusted under 35 U.S.C. 154(b) by 0 days.

(21) Appl. No.: 12/224,059

(22) PCT Filed: Mar. 22, 2007

(86) PCT No.: PCT/JP2007/056747

§ 371 (c)(1),
(2), (4) Date: Aug. 15, 2008

(87) PCT Pub. No.: WO2007/111360

PCT Pub. Date: Oct. 4, 2007

(65) Prior Publication Data

US 2009/0229334 A1 Sep. 17, 2009

(30) Foreign Application Priority Data

Mar. 24, 2006 (JP) ..... 2006-082903

(51) Int. Cl.
*B21C 1/02* (2006.01)
*B21C 1/04* (2006.01)

(52) U.S. Cl. ..... 72/289; 72/278

(58) Field of Classification Search ..... 72/278, 72/279, 281, 286, 287, 288, 289, 183, 205, 72/250, 251; 242/364.11–364.3
See application file for complete search history.

(56) References Cited

U.S. PATENT DOCUMENTS 2,153,192 A 4/1939 Koontz

FOREIGN PATENT DOCUMENTS

CH 634759 A5 2/1983

(Continued)

OTHER PUBLICATIONS

Derwent abstract of JP63299810.*
Derwent abstract of JP58116922.*

*Primary Examiner*—Dana Ross
*Assistant Examiner*—Mohammad Yusuf
(74) *Attorney, Agent, or Firm*—Isabelle R. McAndrews

(57) ABSTRACT

A wire drawing machine comprises a wire supply unit with an unwinding bobbin for unwinding a wire, a wire drawing unit or units for drawing and reducing the diameter of the wire, and a wire winding unit for winding the drawn wire. Each wire drawing unit comprises: a dancer roller for applying back tension to the wire; a wire drawing die for reducing the diameter of the wire; and a capstan for winding and transporting the wire without slip to apply front tension to the wire. The dancer roller is linearly moved substantially in parallel to direction of wire drawing of the wire drawing die, whereby the wire drawing unit can be reduced in width. A plurality of such wire drawing units can be placed between the wire supply unit and the wire winding unit in multiple rows so as to further reduce the width of the wire drawing machine.

3 Claims, 6 Drawing Sheets

FOREIGN PATENT DOCUMENTS

| | | | | | |
|---|---|---|---|---|---|
| DE | 29802989 | U1 | | 6/1998 | |
| GB | 486997 | A | | 6/1938 | |
| JP | 58116922 | | * | 7/1983 | ..... 72/189 |
| JP | 63299810 | | * | 12/1988 | ..... 72/189 |
| JP | 10-180342 | | | 7/1998 | |
| JP | 2005-103623 | A | | 2/2005 | |

* cited by examiner

WIRE DRAWING MACHINE AND METHOD

TECHNICAL FIELD

The present invention relates to a wire drawing machine and a wire drawing method, particularly a wire drawing machine of a non-slip type which uses a single or multiple wire drawing dies to enable drawing of a metal wire into a fine or superfine metal wire e.g. having a diameter of 50 μm or smaller.

BACKGROUND ART

Japanese Laid-open Patent Publication 2005-103623 discloses a wire drawing machine of a non-slip type using an unwinder for unwinding a metal wire to be drawn, a winder for winding the metal wire, and a wire drawing unit for drawing the metal wire. The wire drawing unit is formed of a capstan for drawing (or moving) the metal wire without slip, a dancer roller for applying back tension to the metal wire, and a wire drawing die for reducing the wire diameter. A plurality of such wire drawing units are connected in series between the unwinder and the winder. On the other hand, Japanese Laid-open Patent Publication Hei 10-180342 discloses a wire drawing machine to reduce its size, in which a wire to be drawn is sequentially wound around multiple capstans arranged in series and is transported therethrough, and is also allowed to pass through wire drawing dies placed between adjacent ones of the capstans, so as to draw and reduce the diameter of the wire sequentially through the dies. The capstans are sequentially placed in a zigzag arrangement in the transport direction of the wire so as to form multiple sets of capstans, each set of which consists of three adjacent capstans. Further, a single transmission gear is placed in each set of capstans so that the three capstans in each set are mutually rotated.

However, the conventional wire drawing machines have problems. For example, in the wire drawing machine of Japanese Laid-open Patent Publication 2005-103623, the dancer roller of each wire drawing unit for the application of tension is supported by an end of a dancer arm and driven to pivot about the other end of the dancer arm as a fulcrum. In the wire drawing unit, the wire (to be drawn) having passed the dancer roller is not directly inserted into the wire drawing die, but is required to pass an input guide roller so as to reverse the transport direction of the wire before being inserted into the wire drawing die. Furthermore, the pivot fulcrum of the dancer arm is distant from the wire drawing die in a direction substantially perpendicular to the direction of wire drawing of the wire drawing die, causing the occupying space of the wire drawing unit to be large. As a result, the wire drawing machine using the wire drawing unit or a plurality of such wire drawing units connected to each other becomes large in size. There is a possibility for the wire drawing machine with the multiple connected wire drawing units to be very long in the direction of the connection.

Besides, the pulling or drawing force of a capstan to pull a wire depends on a winding or wrap angle of the wire on the capstan. In the wire drawing machine of Japanese Laid-open Patent Publication 2005-103623, the winding angle of the wire on the capstan is small, and is at most 180 degrees. (Refer to the capstan 57 in FIG. 1 therein). Accordingly, the pulling force of the capstan to pull the wire therein is smaller to cause less stable wire transport than in the case where the wire is wound around the capstan multiple times.

On the other hand, in the wire drawing machine of Japanese Laid-open Patent Publication Hei 10-180342, one wire drawing die (D1) is placed between two capstans (K1, K2) in each set of three capstans to cause the two capstans to have different rotation numbers so as to generate a pulling force to pull the wire. Thus, it is required to finely control the rotation numbers of the two capstans. However, such fine control is difficult because the wire drawing machine has multiple sets of capstans, each set of which has three adjacent capstans. An insufficiently fine control is likely to cause slippage between the wire and the capstans, which in turn damages and strains the wire, and is very likely to cause gears for driving the capstans to make noise during high speed rotation.

The wire drawing machine of Japanese Laid-open Patent Publication Hei 10-180342 further describes a proposal to arrange two rows (upper and lower) of wire drawing units, each unit consisting of capstans and wire drawing dies, allowing a shorter length of the total connected wire drawing units than a single row arrangement. However, in order to place a wire over and between the wire drawing units in the upper row, the wire drawing units in the lower row are likely to hinder and make difficult the operation of placing the wire over and between the wire drawing units. In addition, the arrangement of this wire drawing machine requires that a wire supply unit for supplying the wire and a wire receiving or winding unit for receiving the diameter-reduced wire be positioned at both ends of the total connected wire drawing units, which are apart from each other in the direction of the connection of the wire drawing units. This causes the size of the wire drawing machine in the direction of the connection of the wire drawing units to be thereby larger.

DISCLOSURE OF INVENTION

An object of the present invention is to provide a wire drawing machine and a wire drawing method of a non-slip type, which allows the size of the wire drawing machine to be small, and which, when using and connecting multiple wire drawing units, can achieve size reduction in width or in the direction of the connection of the wire drawing units and achieve a small-sized wire drawing machine with multiple wire drawing units, and further which can facilitate operation of placing a wire (to be drawn) over and between the wire drawing units.

According to a first aspect of the present invention, the above object is achieved by a wire drawing machine comprising a wire drawing unit which comprises: a dancer roller for applying back tension to a wire to be drawn; a wire drawing die for reducing a diameter of the wire; and a capstan for winding and transporting the wire without slip to apply front tension to the wire, wherein the dancer roller is linearly moved substantially in parallel to a direction of wire drawing of the wire drawing die. The wire drawing machine according to the first aspect of the present invention makes it possible to reduce its width, even with a single wire drawing unit.

Preferably, the wire drawing unit further comprises a separate roller placed near the capstan for winding and transporting the wire in combination with the capstan in which axis of the separator roller is slightly tilted relative to that of the capstan to allow turns of the wire wound around the capstan to be positioned at different positions on the capstan. This structure allows the wire to be wound around or contact with the capstan at least two times, and makes it possible to increase the pulling or drawing force of the capstan (front tension), thereby stably and securing transporting and drawing the wire.

Further preferably, the wire drawing unit further comprises: a feed-in guide roller placed on wire input side of the capstan between the wire drawing die and the capstan for transporting the wire to the capstan; a feed-out guide roller placed on wire output side of the capstan for transporting the wire from the capstan; and a bent surface having a base surface and an inclined surface inclined from the base surface toward rear of the wire drawing machine, wherein the dancer roller, the wire drawing die, the feed-in guide roller and the feed-out guide roller are placed on the base surface, while the capstan and the separate roller are placed on the inclined surface. This provides an advantage of enabling smooth adjustment of the position or height of the wire on the capstan and the separate roller on the wire output side, and also enabling easy placement of the wire over and between various elements in the wire drawing unit before starting the wire drawing.

Furthermore, the wire drawing machine can be designed so that it further comprises: a wire supply unit for supplying the wire to the wire drawing unit; and a wire winding unit for winding the wire from the wire drawing unit. This facilitates practical use of the wire drawing machine.

According to a second aspect of the present invention, the above-described object is achieved by a wire drawing machine comprising: a wire supply unit for supplying a wire to be drawn; multiple wire drawing units connected to each other for sequentially drawing the wire; and a wire winding unit for winding the wire from the capstan, in which each of the wire drawing units comprises: a dancer roller for applying back tension to the wire; a wire drawing die for reducing a diameter of the wire; and a capstan for winding and transporting the wire without slip to apply front tension to the wire, wherein the dancer roller is linearly moved substantially in parallel to a direction of wire drawing of the wire drawing die. The wire drawing machine according to the second aspect of the present invention makes it possible to reduce its width, particularly with multiple wire drawing units connected to each other.

Preferably, each of the wire drawing units further comprises a separate roller placed near the capstan in which axis of the separator roller is slightly tilted relative to that of the capstan to allow turns of the wire wound around the capstan to be positioned at different positions on the capstan. This structure allows the wire to be wound around or contact with the capstan at least two times, and makes it pulling or drawing force of the capstan (front tension) in the case of multiple wire drawing units connected to each other, thereby stably and securing transporting and drawing the wire.

Further preferably, each of the wire drawing units further comprises: a feed-in guide roller placed on wire input side of the capstan between the wire drawing die and the capstan for transporting the wire to the capstan; a feed-out guide roller placed on wire output side of the capstan for transporting the wire from the capstan; and a bent surface having a base surface and an inclined surface inclined from the base surface toward rear of the wire drawing machine, wherein the dancer roller, the wire drawing die, the feed-in guide roller and the feed-out guide roller are placed on the base surface, while the capstan and the separate roller are placed on the inclined surface. This provides an advantage of enabling smooth adjustment of the position or height of the wire on each capstan and each separate roller on the wire output side, and also enabling easy placement of the wire over and between various elements in each wire drawing unit in the multiple wire drawing units before starting the wire drawing.

Still further preferably, the wire drawing units are arranged in at least two rows, such that a lower row in a pair of adjacent rows of wire drawing units is positioned at a level indented from that at which an upper row in the pair is positioned. This increases the advantage of enabling smooth adjustment of the position of the wire on each capstan, and at the same time, provides an advantage of easier placement of the wire over and between the multiple wire drawing units before starting the wire drawing.

According to a third aspect of the present invention, the above-described object is achieved by a wire drawing method comprising: winding a wire to be drawn around a substantially half circumference of a dancer roller for applying back tension to the wire; and transporting the wire from the dancer roller to a wire drawing die for reducing a diameter of the wire, and then to a capstan for winding and transporting the wire without slip to apply front tension to the wire, wherein the dancer roller is linearly moved substantially in parallel to a direction of wire drawing of the wire drawing die. The wire drawing method according to the third aspect of the present invention makes it possible to reduce the width of a wire drawing system, either with a single wire drawing unit or with multiple wire drawing units.

Preferably, this method further comprises placing a separate roller near the capstan for winding and transporting the wire in combination with the capstan in which axis of the separator roller is slightly tilted relative to that of the capstan to allow turns of the wire wound around the capstan to be positioned at different positions on the capstan. This method allows the wire to be wound around or contact with the capstan at least two times, and makes it possible to increase the pulling or drawing force of the capstan (front tension), thereby stably and securing transporting and drawing the wire.

BRIEF DESCRIPTION OF DRAWINGS

FIG. 7A is a schematic enlarged side view of a portion of the wire drawing machine of FIG. 6, while

BEST MODE FOR CARRYING OUT THE INVENTION

Figure 1:
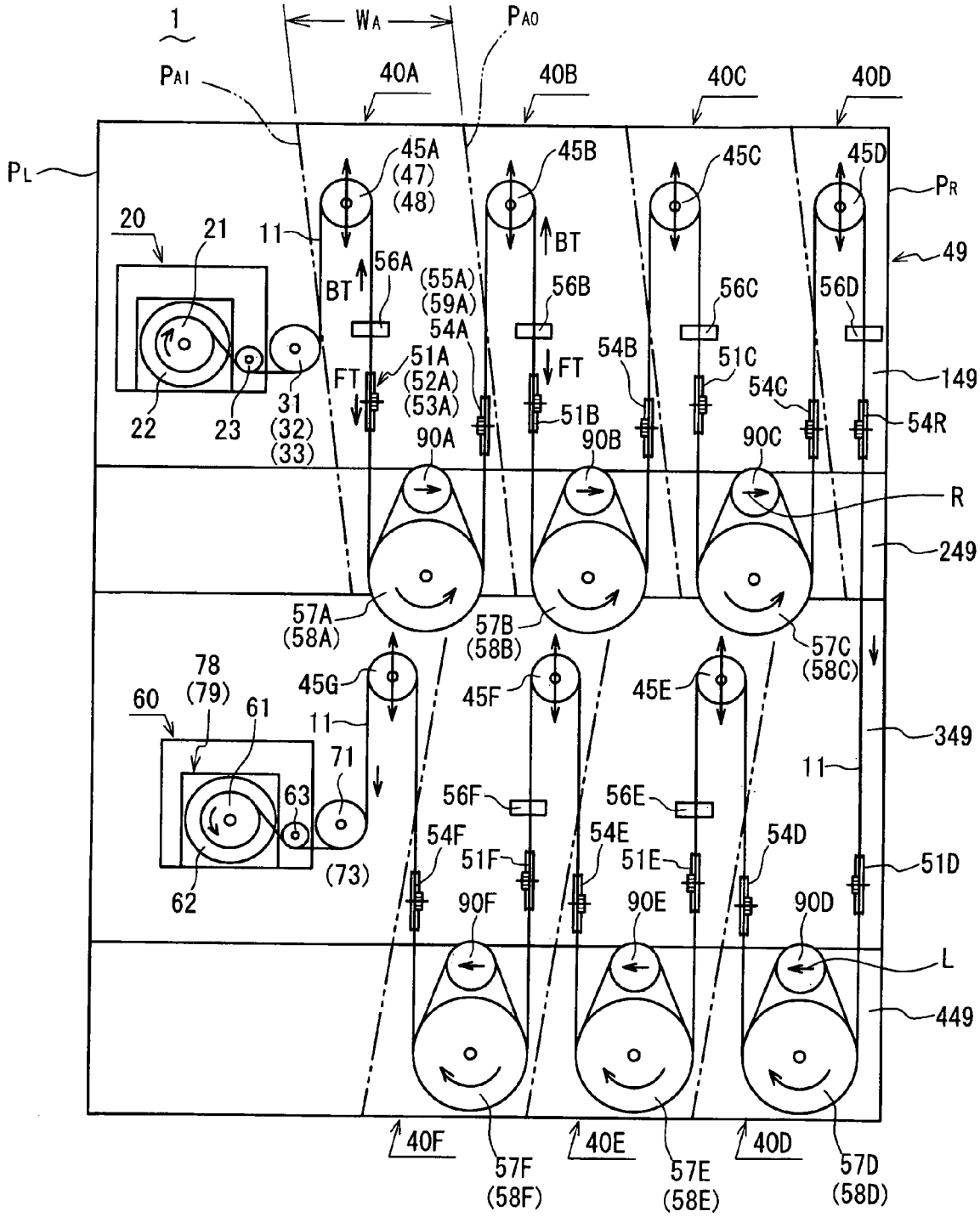
FIG. 1 is a schematic front view of a wire drawing machine according to an embodiment of the present invention.

A wire drawing machine and a wire drawing method (hereafter often referred to collectively as "wire drawing system") of a non-slip type according to an embodiment of the present invention use at least one wire drawing unit having a capstan and a dancer roller in order to draw (transport) a wire such as a metal wire. The wire drawing system or unit of the present embodiment can be used to draw any wires, and is particularly suitable for drawing a metal wire e.g. having a diameter of 50 to 100 μm into a superfine metal wire e.g. having a diameter of 50 μm or smaller, for example, as small as 15 μm. A typical example of the metal wire is a gold bonding wire although not limited thereto. Representative examples of the material of the wire are metals such as gold, stainless steel, cupper, brass, aluminum, tungsten, molybdenum and titanium.

Generally, a wire drawing system applies, to a wire, a unidirectional force higher than a resistance force between the wire and a wire drawing die which is generated when the wire passes through the die. The wire drawing system or unit of the present embodiment uses back tension (in addition to front tension) for drawing a wire, and more specifically draws the wire while applying, to the wire before entering the wire drawing die, a force in a direction opposite to the transport direction of the wire, that is backward tension. The wire drawing system using the back tension is based on the principle that if a tensile stress is applied to a wire by pulling the ends of the wire away from each other to near the limit of elasticity, and the wire is moved relative to a wire drawing die to draw the wire, then the drawing resistance is much lower than if a normal drawing force is applied to the wire drawing die by simply drawing the wire. The application of tensile stress is advantageous, for example, because it reduces internal strain and deformation in the wire, and also reduces the contact pressure between the wire and the wire drawing die.

In the present embodiment, an appropriate amount of back tension, which is indicated by arrow BT in FIG. 1, is applied to a wire 11 by a dancer roller 45 (e.g. 45A) placed upstream from a wire drawing die 56 (e.g. 56A), in which the dancer roller 45 is linearly moved substantially in parallel to a direction of wire drawing of the wire drawing die 56. For example, the dancer roller 45 is linearly moved in parallel to the plane of the drawing (FIG. 1) by using a linear motion generating mechanism such as, preferably, a swing arm 346 and a rotary solenoid 47 (refer to FIG. 4 and FIG. 5) which are arranged in a direction substantially perpendicular to the plane of the drawing. Thus, the direction of the movement of the dancer roller 45 is vertical or longitudinal. Because of this movement of the dancer roller 45, each wire drawing unit 40 (e.g. 40A) is reduced in width, regardless of the vertical or longitudinal position of the dancer roller 45.

The swing arm 346 is a cantilever, and is preferably designed to swing or pivot about a fulcrum as a center. The rotary solenoid 47 can be replaced by any appropriate rotation generator such as a torque motor or a servo motor. Note that it is preferable to use a strain gauge (348) and a potentiometer (48) in combination with the swing arm 346 so as to detect a back tension (BT) in the wire 11, a moving position of the dancer roller 45, and so on, and send the detection signals, if necessary, to a system controller 80 so as to allow and control the back tension in the wire 11 and the moving position of the dancer roller 45 to approach their target values or set values. A capstan 57 (e.g. 57A) driven by a capstan motor 58 provides a wire pulling or drawing force (more precisely a front tension FT) to allow the wire 11 to pass through a wire drawing die 56, which is preferably performed without slip and with low noise. Thus, it is preferable to coat the surface of the capstan 57 with an elastic material such as polyurethane rubber.

It is preferable to place a separate roller 90 (e.g. 90A) near the capstan 57 in which the axis of the shaft of the separate roller 90 extends in a direction roughly aligned with that of the capstan 57 so as to allow the wire 11 to be wound or wrapped around (circumferential surfaces of) the capstan 57 and the separate roller 90. At the same time, it is preferable to tilt the axis of the shaft of the separate roller 90 slightly in an appropriate amount in one direction (any direction) relative to that of the capstan 57. This allows that when the wire 11 is wound around (parts of) circumferential surfaces of the capstan 57 and the separate roller 90 multiple times so as to form multiple turns, one of the turns passes a position (height from a surface to place the capstan 57 and the separate roller 90 on) on the circumferential surface of each of the capstan 57 and the separate roller 90 which position is different (higher or lower) that of a further one of the turns, namely that the position of the one turn is spaced from the position of the further one turn.

Thus, it is possible to prevent the multiple turns of the wire 11 from overlapping each other on the circumferential surfaces of the capstan 57 and the separate roller 90. In other words, it is possible that a wire 11 having passed through the wire drawing die 56 and thereby reduced in diameter can be wound multiple times around parts of the circumferential surfaces of the capstan 57 at positions (heights) thereon different from each other. This winding of the wire 11 in multiple turns at different positions on the capstan 57 stabilizes tension, i.e. front tension indicated by arrow FT in FIG. 1, between the wire drawing die 56 and the capstan 57, and facilitates setting of the tension, making it possible to stably and securely reduce the diameter of the wire 11. Note that a pulling or drawing force exerted by the wire drawing die 56, namely, a force required for the wire 11 to pass through the wire drawing die 56, is a difference between the front tension FT (output tension) and the back tension BT (input tension) of the wire drawing die 56. Further note that it is preferable to use encoders (33, 53, 59, 73) and strain gauges (32, 52, 55) to detect wire speeds and a wire pulling or drawing force (front tension) at each wire drawing die 56, and send the detection signals, if necessary, to the system controller 80 so as to allow and control each wire speed and each wire drawing force to approach their target or set values.

In the wire drawing system of the present embodiment, the wire does not slip on the capstan. Thus, the combination of the dancer roller 45, the wire drawing die 56 and the capstan 57 in a wire drawing unit 40 (e.g. 40A) can stably apply a combination of accurate tensions (back tension BT and front tension FT) to the wire 11 without damaging or undesirably straining the wire 11. In addition, the non-slip feature makes it possible to cut the relationship (connection) between upstream and downstream tensions, more specifically, between tension upstream of the capstan and tension downstream of the capstan. Accordingly, for example, the above-described tensions (back tension BT and front tension FT) generated by the dancer roller 45A, the wire drawing die 56A and the capstan 57A in the wire drawing unit 40A on the upstream side of the capstan 57A do not affect the corresponding tensions (BT and FT) generated by a subsequent dancer roller 45B, a subsequent wire drawing die 56B and a subsequent capstan 57B in a subsequent wire drawing unit 40B. Thus, the subsequent wire drawing unit 40B can stably apply a combination of accurate tensions (back tension BT and front tension FT) without being affected by the preceding wire drawing unit 40A.

When the wire 11 is pulled and drawn through a die opening of the wire drawing die 56 placed between the dancer roller 45 and the capstan 57, the wire 11 is reduced in diameter (area reduction), whereby the wire 11 is subjected to a wire drawing process. More specifically, the wire 11 is driven by the capstan 57 placed downstream of the wire drawing die 56 so as to be pulled and drawn out of the wire drawing die 56. At this time, the wire 11 is drawn according to an area reduction rate (cross-sectional area reduction rate) of the wire drawing die 56. The wire speed increases according to an increase in an amount of drawing (amount of area reduction). It is apparent that when the wire 11 is sequentially drawn through series-connected multiple wire drawing units 40 (40A, 40B and so on), each comprised of a dancer roller 45, a wire drawing die 56 and a capstan 57, the wire speed (transport speed of the wire 11 driven by the capstans 57 such as 57A, 57B and so on) increases as the area reduction (diameter reduction) increases, namely as the wire 11 is passed through the respective wire drawing dies 56 (56A, 56B and so on).

Appropriate wire drawing dies (56A to 56F) having appropriate area reduction rates (diameter reduction rates) are used for the respective wire drawing units (40A to 40F) so as to allow the wire drawing units to reduce the diameter (area) of the wire 11 gradually from the first (40A) to the last (e.g. 40F) of the series-connected wire drawing units. In particular, the last wire drawing unit (e.g. 40F) used here has a die opening to allow (reduce) the wire 11 to have a desired diameter (finish diameter). Note that it is preferable to prepare oil baths so as to immerse the wire drawing dies (56A to 56F) in the oil baths, respectively, for the purpose of preventing the wire 11 from vibrating and improving the stability of the wire transport. Further note that the pulling or drawing force applied by a wire drawing die, namely a machining power required for the wire 11 to pass through the wire drawing die, is a difference between an output tension (front tension FT) and an input tension (back tension BT) after and before the wire drawing die.

As described above, the wire drawing unit 40 according to the present embodiment, which itself can be used as a wire drawing machine, is designed such that the dancer roller 45 is linearly moved substantially in parallel to the direction of wire drawing of the wire drawing die 56. This makes it possible to reduce a width of each wire drawing unit. In FIG. 1, the width of the first wire drawing unit 40A is indicated by WA which is a distance between an input position (substantial horizontal position in FIG. 1) of the wire drawing unit 40A indicated by $P_{AI}$ and an output position (also substantial horizontal position in FIG. 1) of the wire drawing unit 40A indicated by $P_{AO}$. Thus even if a plurality of such wire drawing units (40A, 40B and so on) are connected in series in the width direction to form a wire drawing machine with multiple wire drawing units 40, the wire drawing machine can have a reduced width.

Furthermore, it is preferable to provide the wire drawing unit 40 (e.g. 40A) with a bent surface (first bent surface) having a first base surface (vertically extending flat surface) 249 and a first inclined surface (flat surface) 249 inclined from, and relative to, the first base surface 149 toward rear of the wire drawing unit 40 (40A), and to place a dancer roller 45 (45A) and guide rollers 51, 54 (51A, 54A) on the first base surface 149 while placing a capstan 57 (57A) and a separate roller 90 (90A) on the first inclined surface. The use of the bent surface formed of the first base surface 149 and the first inclined surface 249 provides an advantage of enabling smooth adjustment of the position (height from the first inclined surface 249) of the wire 11 on the capstan 57 (57A) and the separate roller 90 (90A) on the wire output side. This advantage obtained by using the bent surface increases in the case where multiple (two or more) wire drawing units (40A, 40B or more) are connected to form a wire drawing machine with multiple wire drawing units in one row using the first bent surface, or in two rows using the first bent surface and second bent surface having a second base surface (vertically extending flat surface 349) and a second inclined surface (flat surface 449), or in another multi-row arrangement. The advantage of using the bent surface or surfaces will be described below.

In a first wire drawing unit, for example 40A, the wire 11 having passed the dancer roller 45A and the wire drawing die 56A placed on thefirst base surface 149 is guided by a feed-in guide roller 51A, which is positioned on a wire input side of the capstan 57A, so as to be transported at a predetermined level or height from the first base surface 149 (i.e. at a farthest position of the feed-in guide roller 51A from the first base surface 149), and is wound around (a part of) the capstan 57A at a first position (height from the first inclined surface 249) on the capstan 57A, then around (a part of) the separate roller 90A, and then further back around (a part of) the capstan 57A at a second position (height from the first inclined surface 249) of the capstan 57A. Because of a tilt of the shaft of the separate roller 90A relative to that of the capstan 57A, the second position of the wire 11 on the capstan 57A is different (higher in FIG. 7A) from the first position thereof. This difference, if not corrected or adjusted, makes it difficult to smoothly transport the wire 11 to a subsequent dancer roller 45B of a subsequent wire drawing unit 40B (or to a wire winding unit 60).

Figure 6:
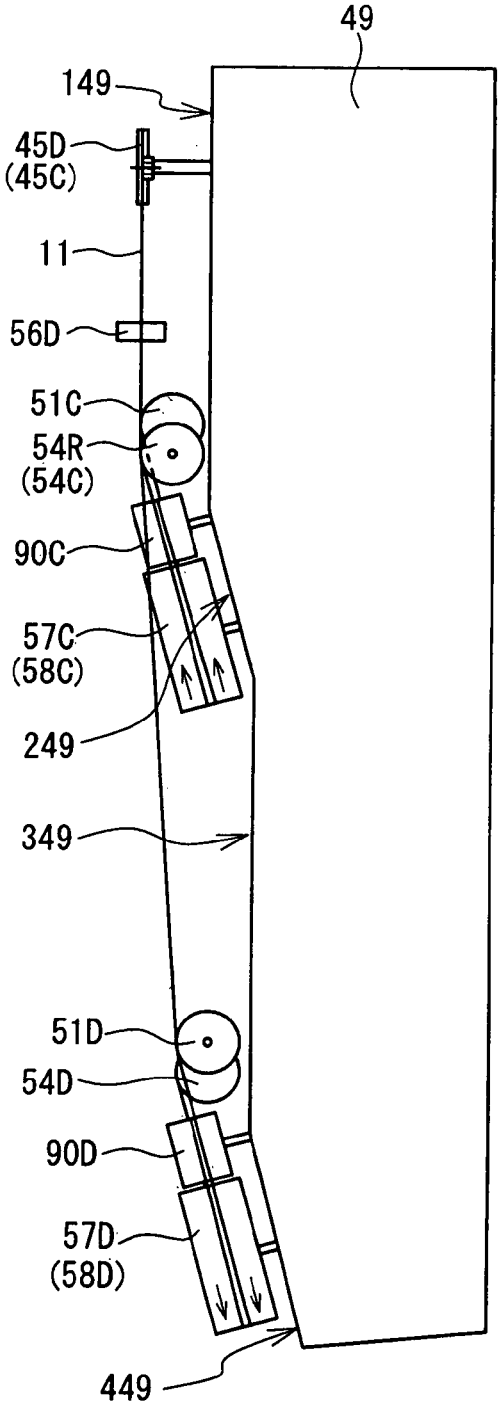
FIG. 6 is a schematic side view of the wire drawing machine of FIG. 1.
Figure 7A:
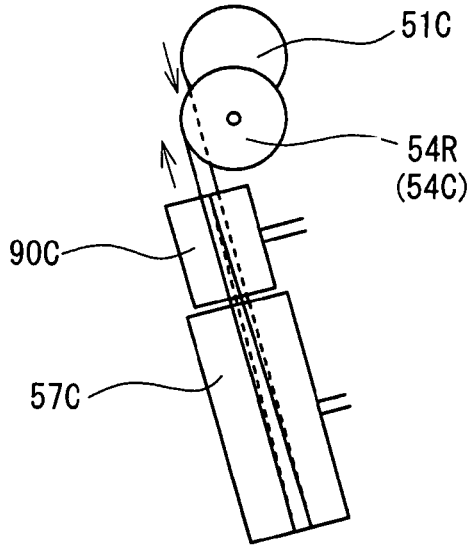

However, because of the first inclined surface 249, the wire 11 from the second position of the capstan 57A can be guided by a feed-out guide roller 54A, which is positioned on a wire output side of the capstan 57B, so as to allow the wire 11 to be transported at the same level as the predetermined level if the feed-out guide roller 54A is positioned at a longitudinal position different from that at which the feed-in guide roller 51A is positioned as seen in FIG. 1, FIG. 6 or FIG. 7A (the longitudinal position or vertical position of the feed-in guide roller 51A being higher than that of the feed-out guide roller 54A in these drawings), even if the feed-out guide roller 54A is placed on the same first base surface 149 for the feed-in guide roller 51A to be placed on, with the farthest point of the feed-out guide roller 54A from the first base surface 149 being maintained at the same level as that of the feed-in guide roller 51A.

Thus, in the first wire drawing unit 40A, the feed-out guide roller 54A placed on the wire output side of the capstan 57A and on the first base surface 149, can adjust the wire height (from the first base surface 149) to the wire height (from the same first base surface 149) on the wire input side of the capstan 57A as defined by the feed-in guide roller 51A placed on the wire input side of the capstan 57A and on the same first base surface 149. Hence, the wire 11 can be easily and smoothly adjusted in height, without damaging or straining the wire 11, by using two guide rollers 51A, 54A placed on the same first base surface on the wire input and output sides, respectively, of the capstan 57A. This feature obtained by using the bent surface or first inclined surface 249 is advantageous even in a wire drawing system using a single wire drawing unit (e.g. 40A) placed between a wire supply unit (20) and a wire winding unit (60), because it facilitates the wire height adjustment on the capstan (57A) and the separate roller (90A), and also facilitates placing the wire 11 over and between the dancer roller (45A), the wire drawing die (56A), the feed-in guide roller (51A), the capstan (57A), the separate roller (90A) and the feed-out guide roller (54A).

This wire height adjustment between the heights on the wire input and output sides of the capstan 57A (and hence between the pair of wire drawing units 40A, 40B) is also performed with respect to the other capstans (57B, 57C and so on) (and hence between the other adjacent pairs of wire drawing units). Note that the bent surface composed of the first base surface and the first inclined surface not only makes it easy to adjust the height of the wire 11 between the heights on the capstan on the wire input and output sides of the capstan, but also facilitates the operation of placing the wire 11 over and between multiple, such as two, wire drawing units (over and between the dancer rollers, the wire drawing dies, the capstans, the guide rollers and the like) before starting the wire drawing.

On the other hand, if the separate roller 90 and the capstan 57A were placed on the first base surface 149 (without providing the first inclined surface 249), it would be necessary to provide two height-adjustment guide rollers on the wire output side of the capstan 57A, such that a first height-adjustment guide roller is placed at the same level (second position) as that of the wire 11 on the capstan 57A on the wire output side of the capstan 57A, and that a second height-adjustment guide roller is placed after the first height-adjustment guide roller and at a lower level (first position) than the first height-adjustment guide roller. It is likely that the distance between the two height-adjustment guide rollers is required to be short, and the use of such two short-distanced guide rollers on the wire output side of the capstan 57A is likely to damage and strain the wire 11. Furthermore, it is not easy to place a wire 11 over and between multiple wire drawing units (over and between the dancer rollers, the wire drawing dies, the capstans, the guide rollers and the like) before starting the wire drawing, if the separate rollers and the capstans of the multiple wire drawing units are placed on the same flat surface on which the dancer rollers and the wire drawing dies of the multiple wire drawing units are placed.

Next, it will be described how to reduce the width of the wire drawing machine 1 using multiple wire drawing units 40 (40A, 40B and so on). More specifically, by arranging multiple wire drawing units 40 in two rows or decks (upper and lower) or in another multi-row arrangement to form a wire drawing machine 1, the width of the wire drawing machine 1 can be further reduced. In the case of the two-row or two-deck arrangement, it is preferable to arrange the rows or decks in a U-shaped arrangement so that a wire supply unit (unwinding unit) 20 and a wire winding unit 60 can be placed on the same side or at a similar horizontal position in the wire drawing machine 1. FIG. 1 shows an example of such two-row U-shaped arrangement, in which the entire width of the wire drawing machine 1 is a distance between a leftmost position indicated by $P_L$ and a rightmost position indicated by $P_R$. In FIG. 1, the wire supply unit 20 and the wire winding unit 60 are placed on the same side (left) of the wire drawing machine 1.

In the case of the two-row arrangement, it is preferable to make a wire transport plane of the upper (upstream) row different from that of the lower (downstream) row. More specifically, it is preferable to provide the wire drawing units in the upper row on a first bent surface (having a first base surface and a first inclined surface inclined from the first base surface toward rear of the wire drawing units), and the wire drawing units in the lower row on a second bent surface (also having a first base surface and a first inclined surface inclined from the first base surface toward rear of the wire drawing units). More preferably, the second bent surface is indented from the first bent surface, or in other words is closer to rear of the wire drawing units to form a surface-indented structure. This surface-indented structure makes easier the operation, before starting the wire drawing, of placing the wire 11 over and between the multiple wire drawing units (over and between the dancer rollers, the wire drawing dies, the capstans, the guide rollers and the like) in both upper and lower rows.

Here, it should be noted that in each of the wire drawing units, the wire 11 is firmly wound or wrapped around (a part) of the capstan 57 and the separate roller 90 (much more firmly than in the prior art wire drawing machine of Japanese Laid-open Patent Publication 2005-103623) with a minimum number of turns. According to the present embodiment, the wire 11 from a feed-in guide roller 51 at least contacts the capstan 57 (about 180 degrees therearound), then the separate roller 90 (less than 180 degrees or about 90 degrees therearound), and then the capstan 57 again (about 180 degrees therearound again). This constitutes the minimum (least) number of wire turns in each wire drawing unit before the wire 11 is transported and guided by a feed-out guide roller 51. According to the present specification, this minimum (least) number of wire turns (one contact on the separate roller and two contacts on the capstan, i.e. at least two turns on the capstan) is defined as one-loop winding. Because of the use of the separate roller, a firmer winding on the capstan can be achieved even by the one-loop winding than in the prior art. In the wire drawing machine or system of the present embodiment, the firmness of the winding increases as the number of wire turns increases from the one-loop winding to a two-loop winding (two contacts on the separate roller and three contacts on the capstan) or further to another multi-loop winding.

The following describes a wire supply unit 20 for unwinding or supplying a wire 11 to be drawn, and a wire winding unit 60 for winding a wire 11 after reduced in diameter. The wire supply unit 20 preferably comprises a unwinding bobbin 21 having a wire 11 wound therearound, an unwinding motor 22 for rotating the unwinding bobbin 21, guide rollers 23, 31 for guiding the wire 11 in a predetermined direction, a wire supply unit controller 30 for controlling the wire supply unit 20, and so on. It is further preferable to provide the guide roller 31 with a strain gauge 32 for detecting tension of the wire 11 to be supplied or drawn as well as an encoder 33 for detecting speed (unwinding speed) of the wire 11.

On the other hand, the wire winding unit 60 preferably comprises guide rollers 71, 63 for guiding the wire 11 in a direction to wind it, a winding bobbin 61 for winding the wire 11 therearound, a winding motor 62 for rotating the winding bobbin 61, a traverse slide rail 79 for the winding bobbin 61 to traverse, a drive motor 78 for traversely driving the winding bobbin 61 on the traverse slide rail 79, a wire winding unit controller 70 for controlling the wire winding unit 60, and so on. It is further preferable to provide the guide roller 71 with an encoder 73 for detecting winding speed of the wire 11, which speed is determined by circumferential speed of the winding bobbin 61, namely by the rotation speed of the winding motor 62.

Figure 2:
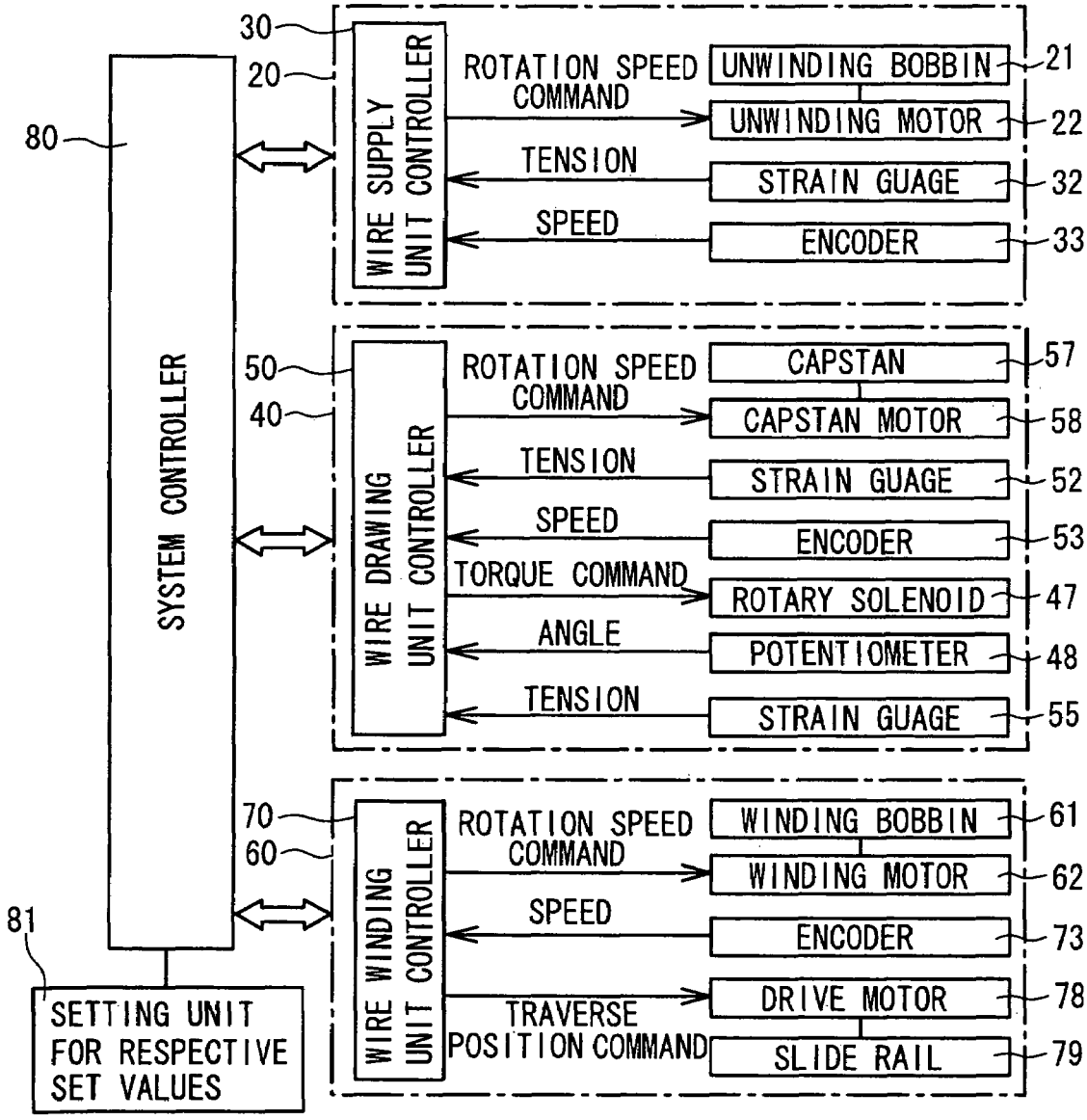
FIG. 2 is a schematic block diagram of the wire drawing machine shown in FIG. 1.

Referring now to FIG. 2, the wire drawing system (machine) according to the present embodiment comprises a system controller 80 as control means to control the entire wire drawing system. The system control 80 is connected to the wire supply unit controller 30 for controlling the wire supply unit 20, each wire drawing unit controller 50 for controlling each wire drawing unit 40 (e.g. 40A), and the wire winding unit controller 70 for controlling the wire winding unit 60. Note that FIG. 2 shows one of the wire drawing unit controllers 50 as a representative. The wire supply unit controller 30, each wire drawing unit controller 50 and the wire winding unit controller 70 control the wire supply unit 20, each wire drawing unit 40 and the wire winding unit 60, respectively, in one-to-one correspondence, while the system controller 80 controls interactions between the wire supply unit 20, the wire drawing units 40, the wire winding unit 60 and other elements. Similarly, each wire drawing unit control 50 controls each wire drawing unit 40 directly connected thereto, while the system controller 80 controls interactions between the wire drawing units 40.

It is also possible to allow the system controller 80 to perform all these control functions (controls of the entire wire drawing system as well as of the wire supply unit 20, the wire drawing units 40 and the wire winding unit 60) without using or providing the wire supply unit controller 30, the wire drawing unit controllers 50 and the wire winding unit controller 70. Furthermore, the system controller 80 has connected thereto a setting unit 81 for setting various set values such as a target value of the tension of the wire 11. The set values set by the setting unit 81 are stored in a memory in the system controller 80 or in memories in the respective controllers 30, 50 and 70. It is apparent that the respective controllers 30, 50 and 70 are designed, to have setting units for setting the set values, respectively.

EXAMPLE

Figure 3:
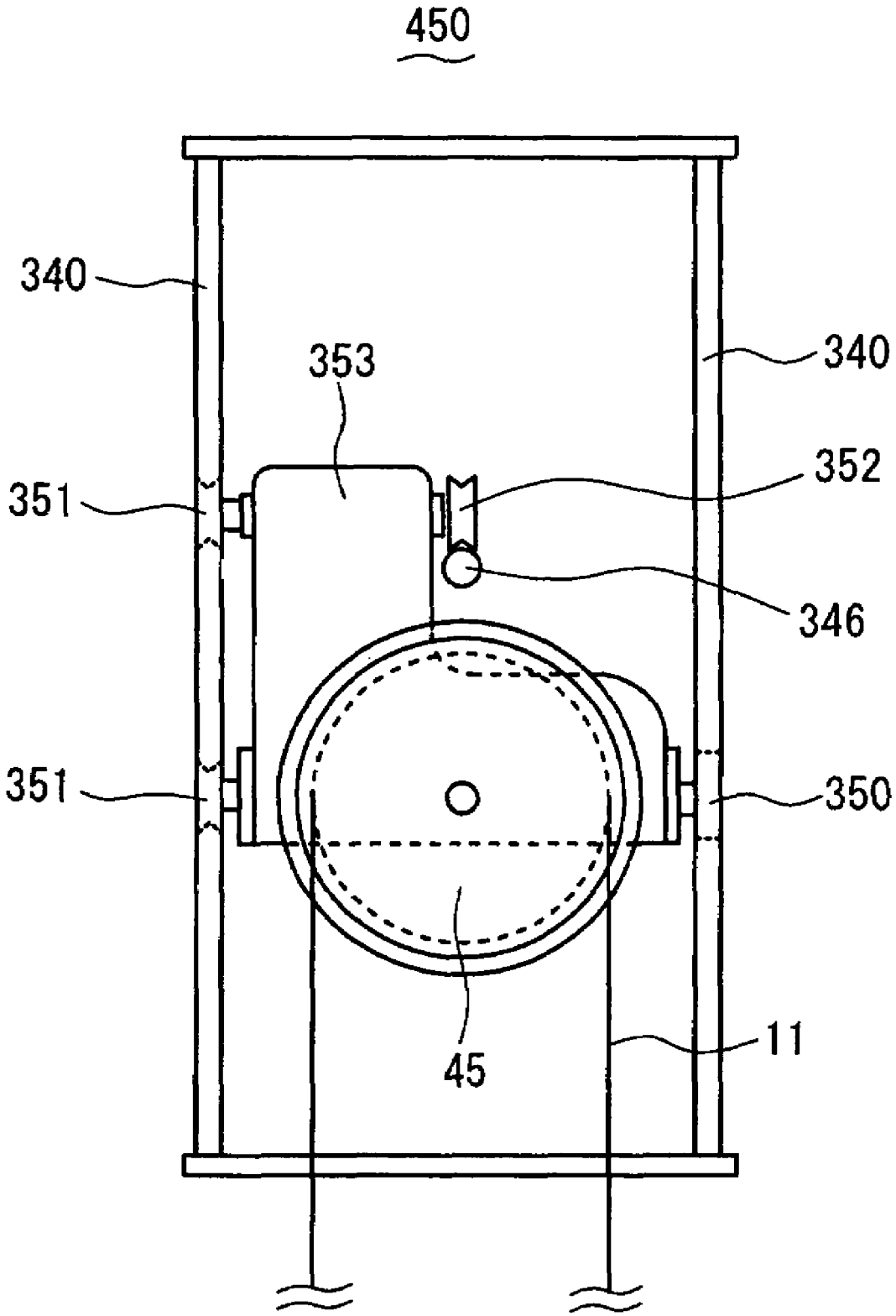
FIG. 3 is schematic front view of a main part of a dancer roller unit having a dancer roller in a wire drawing unit of the wire drawing machine.
Figure 4:
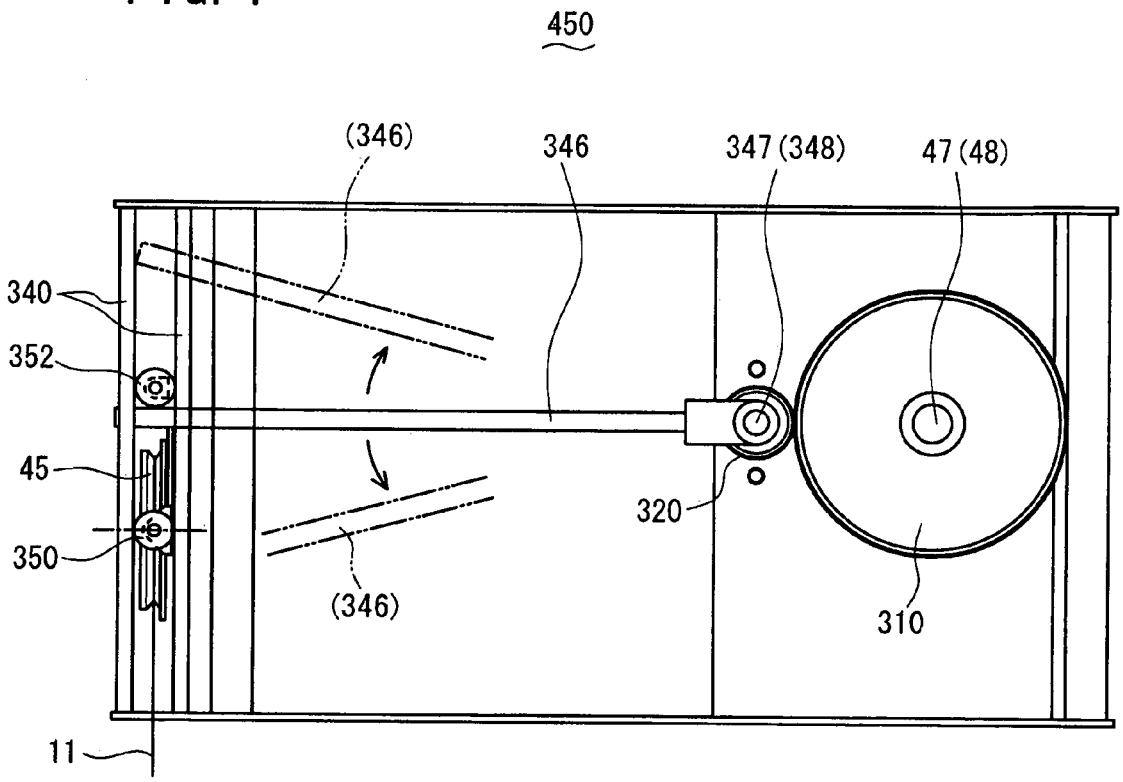
FIG. 4 is a schematic side view a main part of the dancer roller unit of FIG. 3.
Figure 5:
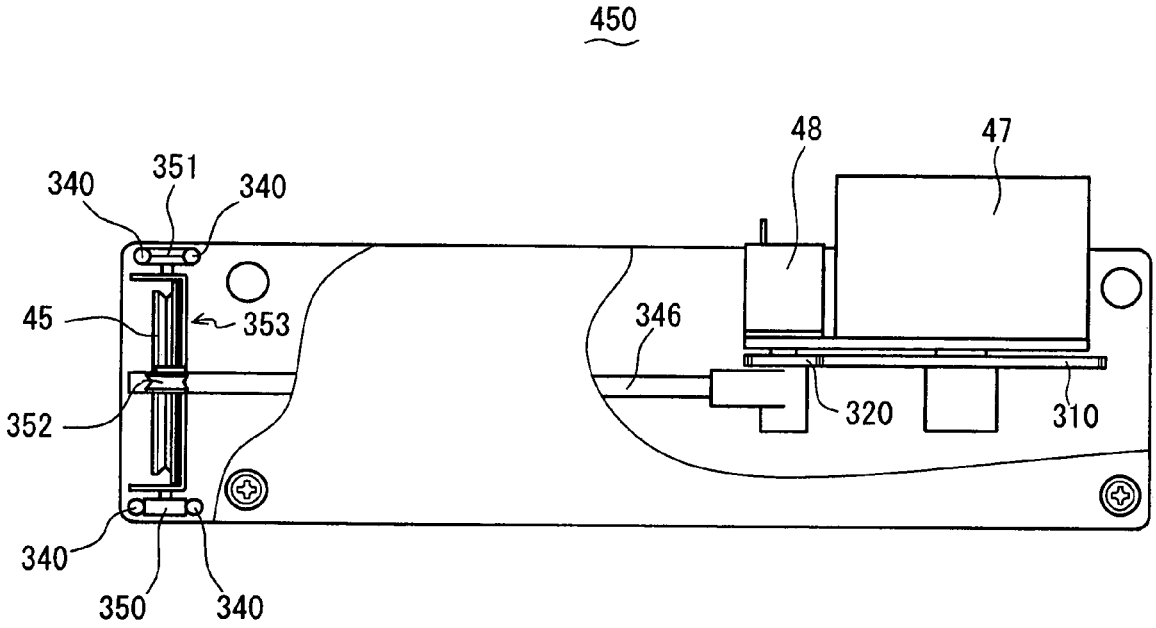
FIG. 5 is a schematic front view, partially cut away, of a main part of the dancer roller unit of FIG. 3.
Figure 7B:
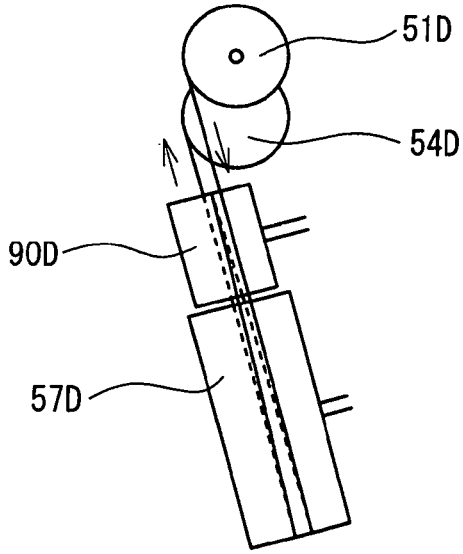
FIG. 7B is a schematic enlarged side view of a portion of the wire drawing machine 1 of FIG. 6.

Hereinafter, the wire drawing machine or system according to the present invention will be described, using the wire drawing machine 1 shown in the annexed drawings as an example, in which FIG. 1 is a schematic front view of the wire drawing machine 1 according to the example, while FIG. 2 is a schematic block diagram of the wire drawing machine 1 shown in FIG. 1. On the other hand, FIG. 3 is schematic front view of a main part of a dancer roller unit 450 having a dancer roller 45 in a wire drawing unit (40), and FIG. 4 is a schematic side view a main part of the dancer roller unit 450 of FIG. 3, while FIG. 5 is a schematic front view, partially cut away, of a main part of the dancer roller unit 450 of FIG. 3. Further, FIG. 6 is a schematic side view of the wire drawing machine 1 of FIG. 1, while FIG. 7A is a schematic enlarged side view of a portion of the wire drawing machine 1 of FIG. 6, showing guide rollers 51C, 54R (54C), a separate roller 90C and a capstan 57C in an upper row of the wire drawing machine 1. Similarly, FIG. 7B is a schematic enlarged side view of a portion of the wire drawing machine 1 of FIG. 6, showing guide rollers 51D, 54D, a separate roller 90D and a capstan 57D in a lower row of the wire drawing machine 1.

FIG. 1 shows an example of the wire drawing machine 1 (wire drawing system) having upper and lower rows of multiple wire drawing units 40A to 40F connected to each other to sequentially draw a wire 1, or subject the wire 11 to six sequential wire drawing steps (wire diameter reduction steps). The wire drawing machine comprises: a wire supply unit 20 for supplying or unwinding a wire 11 such as a metal (gold) wire from an unwinding bobbin 21; wire drawing units 40 (40A to 40F) for drawing the wire; and a wire winding unit 60 for winding the wire 11 after drawn. The wire drawing unit 40 (e.g. 40A) comprises: a wire drawing die 56 (e.g. 56A) for drawing or reducing the diameter of the wire 11; a dancer roller 45 (e.g. 45A) linearly moved substantially in parallel to a direction of wire drawing of the wire drawing die 56 for applying back tension to the wire 11; a capstan 57 (e.g. 57A) and a separate roller 90 (e.g. 90A) for transporting the drawn wire 11 without slip to apply front tension to the wire 11; and feed-in and feed-out guide rollers 51, 54 (e.g. 51A, 54A) for guiding and transporting the wire 11 to and from the capstan 57 (57A), respectively.

Appropriate dimensions can be used for the respective elements and units. For example, the wire 11 at the wire supply unit 20 before drawn can have a starting diameter of 50 to 100 μm to obtain a final diameter of 10 to 50 μm after finally drawn. The wire 11 used in the present example is a gold wire having a starting diameter of 60 μm. Further, the shape and dimension of the dancer rollers 45, the guide rollers 51, 54 (as well as 31, 71) and the dancer rollers 90 can be the same in the present example. For example, each of them has a shape of disk having an outer disk diameter of 40 mm with a thickness of 3 mm, and has a circumferential surface with a circumferential groove having a V-shape in its cross section with an angle of about 60 degrees, in which the bottom of the V-shaped groove defines an inner disk diameter of 36 mm.

The separator rollers 90 have a diameter of 34 mm, while the capstans 57 have a diameter of 80 mm. Commonly used wire drawing dies made of super-hard alloy having a conical shape can be used for the wire drawing dies 56 (56A and so on). For example, each wire drawing die 56 has a length (length of cone) of about 8 mm, and a circular entrance opening having a diameter of 1 mm. The cone is rather sharply tapered from the entrance to about a half length of the wire drawing die 56 where the cone has a diameter of about three times as large as that of an exit thereof, from which the cone is gradually tapered down to a final diameter of the cone at the exit thereof. The wire drawing die 56 has, at its exit portion, a shape of hollow cylinder having a length of 1 mm and a desired diameter for the purpose of wire drawing.

As shown in FIG. 1, six wire drawing units 40 (40A to 40F) are connected to each other and arranged in an upper (upstream) row (four wire drawing dies 56A to 56D) and a lower (downstream) row (two wire drawing dies 56E, 56F) in a U-shaped arrangement. Referring additionally to FIG. 6, FIG. 7A and FIG. 7B, the upper row of wire drawing units 40A to 40C and a part of wire drawing unit 40D (a dancer roller 45D, a wire drawing die 56D and an additional guide roller 54R for transporting the wire 11 to the lower row) except the respective capstans 57A to 57C and separate rollers 90A to 90C are placed on a first base surface 149 of a housing 49. The first base surface 149 stands longitudinally or vertically in FIG. 1 and FIG. 6. The capstans 57A to 57C with the separate rollers 90A to 90C are placed on a first inclined flat surface 249 which is inclined from and relative to the first base surface 149 toward rear of the housing 49.

Similarly, the lower row of wire drawing units 40D to 40F except a part of wire drawing unit 40D (the dancer roller 45D, the wire drawing die 56D and the additional guide roller 54R) and except the respective capstans 57D to 57F with separate rollers 90D to 90F are placed on a second base surface 349 (vertically or longitudinally extending flat surface) of the housing 49. The second base surface 349 is contiguous to an end of the first inclined surface 249, and stands longitudinally or vertically in FIG. 1 and FIG. 6, and in parallel to the first base surface 149 at a position closer to rear of the housing 49 than the first base surface 149 so as to form a surface-indented structure. The capstans 57D to 57F with the separate rollers 90D to 90F are placed on a second inclined surface (flat surface) 449 which is inclined from and relative to the second base surface 149 toward rear of the housing 49.

Thus, the first base surface 149 and the first inclined surface 249 form a first bent surface, while the second base surface 349 and the second inclined surface 449 form a second bent surface, in which the second bent surface is closer by a predetermined amount to rear of the housing 49 or rear of the wire drawing units 40 than the first bent surface to form a surface-indented structure with the predetermined amount of indentation as shown in FIG. 6. Because of this surface-indented structure, the lower (downstream) row of wire drawing units 40 (40D to 40F) can be prevented from hindering the operation of placing the wire 11 over and between the wire drawing units 40 in the upper (upstream) row prior to the start of the wire drawing. Note that the wire supply unit 20 is placed on the first base surface 149, while the wire winding unit 60 is placed on the second base surface 349.

It is one of the features of the wire drawing machine 1 (or wire drawing unit) or wire drawing system of the present embodiment that a separate roller 90 (e.g. 90A) is placed near each capstan 57 (e.g. 57A) which allows the wire 11 to be transported without slide, and that the shaft (axis) of the separate roller 90 is slightly tilted in an appropriate amount in one direction (any direction) relative to that of the capstan 57. In the present embodiment, the shaft of each separate roller 90 (e.g. 90A) in the upper row is tilted rightward relative to the shaft of the capstan 57 (e.g. 57A) as indicated by arrow R in FIG. 1, while the shaft of each separator roller 90 (e.g. 90D)

in the lower row is tilted leftward relative to the shaft of the capstan 57 (e.g. 57D) as shown by arrow L in FIG. 1. More specifically, a front end of the shaft of each separator roller 90 (e.g. 90A) in the upper row viewable in the front view of FIG. 1 is positioned at a slightly right position relative to a rear end of the shaft of the separator roller 90 (e.g. 90A), while a front end of the shaft of each separator roller 90 (e.g. 90D) in the lower row viewable in the front view of FIG. 1 is positioned at a slightly left position relative to a rear end of the shaft of the separator roller 90 (e.g. 90D).

Using the first wire drawing unit 40A, the operation of each of the wire drawing units 40A to 40C in the upper row will be described below. In the first wire drawing unit 40A, the wire 11 is transported and wound around a substantially half circumference of the dancer roller 45A, and is then directly transported to the wire drawing die 56A placed on the first base surface 149, and is further guided by a feed-in guide roller 51A (also placed on the first base surface 149) so as to be transported at a predetermined height from the first base surface 149 (i.e. at a farthest point of the feed-in guide roller 51A from the first base surface 149). The wire 11 from the wire drawing die 56A via the feed-in guide roller 51A is directly wound around a substantially lower half 180 degree portion of the capstan 57A at a first position (height from the first inclined surface 249) on the capstan 57A, then around a substantially upper 90 degree portion of the separate roller 90A, and then further back around also a substantially lower half 180 degree portion of the capstan 57A at a second position (height from the first inclined surface 249) of the capstan 57A which is higher than the first position.

Here, the capstan 57A is rotated counterclockwise in FIG. 1 by a capstan motor (58A) which is rotatably mounted on the first inclined surface 249 with the shaft of the capstan motor (58A) being perpendicular to the first inclined surface 249. Because of the tilt of the shaft of the separate roller 90A relative to that of the capstan 57A, the second position of the wire 11 on the capstan 57A is different (higher in FIG. 7A) from the first position thereof. Thus, the two turns in one-loop winding of the wire 11 can be prevented from overlapping each other on the circumferential surface of the capstan 57A. (The overlapping of turns can be similarly prevented in any multiple turns in multi-loop winding of the wire 11 on the capstan 57A and the separate roller 90A.) Each of the other wire drawing units 40B, 40C in the upper row operates in the same way as in the first wire drawing unit 40A.

Furthermore, the operation of each of the wire drawing units 40D to 40F in the lower row, including prevention of overlapping of turns of wire 11, is also performed in the same way, except that each of the capstans 57D to 57F rotated by each of the capstan motors (58D to 58F), which is mounted on the second inclined surface 449 with the shaft of each of the capstan motors (58D to 58F) being perpendicular to the second inclined surface 449, is rotated clockwise, while the shaft of each of the separate rollers 90D to 90F is tilted leftward, and that the dancer rollers 45E to 45F, the wire drawing dies 56D to 56F and the feed-in and feed-out guide rollers 51D to 51F and 54D to 54F are placed on the second base surface 349. Similarly, in the lower row, the second position of the wire 11 on each of the capstans 57D to 57F in the second turn is higher than the first position thereof in the first turn.

Referring now additionally to FIG. 3, FIG. 4 and FIG. 5, a dancer roller unit 450 including a dancer roller 45 will be described. The dancer roller 45 is formed of a disk having a substantially V-shaped groove in an outer cylindrical surface thereof, in which the groove is used for supporting and guiding the wire 11. As shown in FIG. 1, the wire 11 is wound around an upper haft circumference or 180 degree portion of the dancer roller 45. The four dancer rollers 45 (45A to 45D) in the upper (upstream) row are linearly moved substantially in parallel to the first base surface 149 of the housing 49, while the three dancer rollers 45 (45E to 45G) in the lower (downstream) row are linearly moves substantially in parallel to the second base surface 349 of the housing 49. More specifically, the opposite disk surfaces of each dancer roller 45 in the upper row linearly move substantially in parallel to the first base surface 149, while the opposite disk surfaces of each dancer roller 45 in the lower row linear move substantially in parallel to the second base surface 349.

As shown in FIG. 5, each dancer roller 45 is rotatably mounted on major surface of a substantially U-shaped plate 353 (U-shaped cross section). The plate 353 is slidably supported by four shafts 340 via four rollers 351 and one roller 350 provided on both sides of the plate 353, respectively. The plate 353 is driven by a swing arm 346 having a circular cross section via a roller 352 mounted on an end of the plate 353. This makes it possible for the dancer roller 45 to linearly move substantially in parallel to the first base surface 149 or the second base surface 349 of the housing 49 as described above. Note that each swing arm 346 in the upper row pivots in a pivot plane substantially perpendicular to the first base surface 149, while each swing arm 346 in the lower row pivots in a pivot plane substantially perpendicular to the second base surface 349.

As shown in FIG. 4, the swing arm 346 is driven by a rotary solenoid 47 via gears 310, 320 to pivot about a fulcrum 347 as a pivot center. Note that the swing arm 346 is connected to a potentiometer 48 to feedback a position signal of the dancer roller 45 to a wire drawing unit controller 50 (refer to FIG. 2) so as to control and allow the swing arm 346 to continuously maintain a reference position such as a substantially central position in a range where the swing arm 346 can pivot. Further note that the rotary solenoid 47, the gears 310, 320, the potentiometer 48 and the like are placed in the housing 49 on the rear of the first base surface 149 in the upper row or on the rear of the second base surface 349 in the lower row.

Referring back to FIG. 1 and now also to FIG. 2, the wire supply unit 20 is formed of an unwinding bobbin 21 having a wire wound therearound, an unwinding motor 22 for rotating the unwinding bobbin 21, guide rollers 23, 31 for guiding the wire 11 in a predetermined direction, a wire supply unit controller 30 for controlling the wire supply unit 20, and so on. The guide roller 31 is provided with a strain gauge 32 for detecting tension of the wire 11 to be supplied or drawn as well as an encoder 33 for detecting speed (transport speed) of the wire 11. Furthermore, the unwinding motor 22 is subjected to feedback control so as to position the swing arm 346 at a reference position set by a setting unit 81. The wire supply unit 20 is mounted as one unit on the first base surface 149 of the housing 49.

The unwinding speed of the wire 11 from the wire supply unit 20 is detected by an encoder 33 which detects the rotation number of the guide roller 31 (or the guide roller 23), and inputs a speed signal thus detected to the wire supply unit controller 30. The thus input speed signal from the guide roller 31 is processed by the wire supply unit controller 30 as a feed forward signal to the unwinding motor 22. A potentiometer 48, detects a pivot angle of the swing arm 346, which is an error component of the feed forward signal, and inputs the thus detected pivot angle to the wire supply unit controller 30. The wire supply unit controller 30 calculates a pivot angle deviation between the thus input pivot angle of the swing arm 346 and a pivot angle of the swing arm 346 when positioned at the reference position set by the setting unit 81. The wire supply unit controller 30 further determines and controls the rotation speed of the unwinding motor 22 to allow this pivot angle deviation to approach 0 (zero), and sends a command (rotation speed command) to the unwinding motor 22. The wire supply unit controller 30 is also connected to a system controller 80 for various controls usable to control e.g. interactions between the wire supply unit controller 30 and the wire drawing unit controller 50 or a wire winding unit controller 70.

Appropriate methods such as P control (proportional control), PI control (proportional plus integral control) and PID control (proportional plus integral plus derivative control) can be used for the wire supply unit controller 30 to control the rotation speed of the unwinding motor 22 by using the pivot angle deviation as a feedback signal. Here, the proportional control is a control which varies a control amount in proportion to a deviation (difference between a set value and a current value). The integral control is a control which calculates a sum of deviations, and varies a control amount in proportion to the sum of deviations. On the other hand, the derivative control is a control which calculates a rate of change of deviation, and varies a control amount in proportion to the rate of change of deviation.

Before starting the wire drawing, the wire 11, which has a starting diameter of about 60 μm in the present example, is placed in the wire drawing machine 1 in order from the upstream (from the wire supply unit 20) to the downstream (to the wire winding unit 60), more specifically over and between the wire drawing units 40A to 40F (over and between the dancer rollers 45, the wire drawing dies 56, the capstans 57, the guide rollers 51, 54 and the like) in both upper and lower rows. At the most upstream site, the wire 11 is placed over and between the wire supply unit 20 and the capstan 57A of the first wire drawing unit 40A via the guide rollers 23, 31, the dancer roller 45A, the wire drawing die 56A and the feed-in guide roller 51A. The respective guide rollers 23, 31, 51 are rotatably supported by the housing 49.

When the wire drawing is started, the wire 11 is pulled by the capstan 57A with the separate roller 90A and unwound by the unwinding bobbin 21, whereby the wire 11 is guided from the wire supply unit 20 to the first wire drawing unit 40A during which the wire 11 is drawn and reduced in diameter at the wire drawing die 56A. The wire drawing die 56A has a roughly conical shape with a hollow cylinder having a length of 1 mm and a diameter of about 47 μm at its exit portion (diameter reduction rate of about 79%). Thus, the wire 11 is reduced by the wire drawing die 56A to a diameter of about 47 μm. Any appropriate transport speed can be used for the wire 11 to pass the wire drawing die 56A or each subsequent wire drawing die 56B to 56F. The transport speed at the exit of the wire drawing die 56A here is 23 m per minute. The transport speed at each wire drawing die increases in proportion to the area reduction rate (here about 62%).

The wire 11 pulled and drawn by the capstan 57A with the separate roller 90A is guided by the feed-out guide roller 54A to be transported to the capstan 57B in the second wire drawing unit 40B. Although the feed-out guide roller 54A is positioned at the same height as that of the feed-in roller 51A, the wire 11 can be wound twice at different heights on the capstan 57A without requiring undesirable height adjustment between the feed-out and feed-in guide rollers 51A, 54A, because the feed-in roller 51A and the feed-out roller 54A are placed at different longitudinal positions (spaced from each other at a predetermined distance) on the first base surface 149, and because the capstan 57A and the separate roller 90A are placed on the first inclined surface 249 inclined from the first base surface 149, and further because the shaft (axis) of the separate roller 90A is tilted relative to the shaft (axis) of the capstan 57A. This wire height adjustment is similarly performed in each of the other wire drawing units 57B to 57F.

The wire 11 having a diameter of about 47 μm from the first wire drawing unit 40A is transported to the capstan 57B with the separate roller 90B in the second wire drawing unit 40B via the dancer roller 45B, the wire drawing die 56B and the feed-in guide roller 51B therein, whereby the wire 11 is guided and transported from the first wire drawing unit 40A to the second wire drawing unit 40B during which the wire 11 reduced in diameter at the wire drawing die 56A is further reduced in diameter at the wire drawing die 56B. The wire drawing die 56B also has a roughly conical shape with a hollow cylinder having a length of 1 mm and a diameter of about 37 μm at an exit portion thereof (diameter reduction rate of about 79%). Thus, the wire 11 is reduced by the wire drawing die 56B to a diameter of about 37 μm by using a wire transport speed of about 37 m per minute.

In this way, the wire drawing processes are repeated at the total six wire drawing units 40A to 40F so as to obtain a resultant wire 11 having been reduced in diameter to a desired value which is 15 μm here. Note the wire transport speed at the exit of the final wire drawing unit is 400 m per minute. Further note that any appropriate wire transport speed can be used at each of the wire drawing dies, but preferably the wire transport speed at the exit of the final wire drawing unit is to be selected e.g. from 400 m to 500 m per minute. As described above, in the present example, the wire 11 has a starting diameter of 60 μm to be supplied to the first wire drawing unit 40A, and is reduced in diameter (cross-sectional area) at a diameter reduction rate of 79% (area reduction rate of 62%) at each of the wire drawing dies 56 into a final diameter of 15 μm. The thus diameter-reduced wire 11 having a diameter of 15 μm is wound by a wire winding unit 60 at the most downstream site.

Each of the wire drawing units 40 has a wire drawing unit controller 50 for controlling the operation thereof. More specifically, the wire drawing unit controller 50 is connected to: each capstan motor 58 for rotation speed command; each strain gauge (52) for tension control; each encoder (53) for rotation speed control; each rotary solenoid 47 for torque command; each potentiometer 48 for angle control; and each strain gauge (55) for tension control. The wire drawing unit controller 50 is also connected to the system controller 80 for the purpose of various controls usable to control e.g. interactions between the wire drawing unit controller 50 and the wire supply unit controller 30 or the wire winding unit controller 70. Appropriate methods such as P control, PI control and PID control as used in the wire supply unit controller 30 can be used in the wire drawing unit controller 50 to control the rotation speed of each capstan motor 58.

The wire winding unit 60 comprises guide rollers 71, 63 for guiding the wire 11, a winding bobbin 61 for winding the wire 11 therearound, a winding motor 62 for rotating the winding bobbin 61, a traverse slide rail 79 for the winding bobbin 61 to traverse, a drive motor 78 for traversely driving the winding bobbin 61 on the traverse slide rail 79, a wire winding unit controller 70 (refer to FIG. 2) for controlling the wire winding unit 60, and so on. The wire supply unit 60 is mounted as one unit on the housing 49. The winding speed of the wire 11 by the wire winding unit 60 is detected by an encoder (73) which is mounted on, and detects the rotation number of, the guide roller 71 (or the guide roller 63). The winding speed is determined by circumferential speed of the winding bobbin 61, namely by the rotation speed of the winding motor 62.

The wire winding unit 60 has a wire winding unit controller 70 for controlling the operation thereof. More specifically, the wire winding unit controller 70 is connected to the winding motor 62 for rotation speed command, the encoder (73) for rotation speed detection, and the drive motor 78 for traverse position command, and is also connected to the system controller 80 for various controls usable to control e.g. interactions between the wire winding unit controller 70 and the wire supply unit controller 30 or the wire drawing unit controller 50. The wire winding unit controller 70 calculates a speed deviation between the wire speed (winding speed) detected by the encoder (73) and a winding command speed optionally set by the setting unit 81.

The wire winding unit controller 70 further determines and controls the rotation speed of the winding motor 62 to allow this speed deviation to approach 0 (zero), and sends a command (rotation speed command) to the winding motor 62. Appropriate methods such as P control, PI control and PID control as usable in the wire supply unit controller 30 can be also used in the wire winding unit controller 70 to control the rotation speed of the winding motor 62 by using the speed deviation as a feedback signal. Using the traverse slide rail 79, the wire 11 is uniformly wound around the winding bobbin 61. Here, the drive motor 78 for traversely driving the winding bobbin 61 is driven synchronously with the rotation speed of the winding motor 62 so as to allow the winding bobbin 62 to reciprocally move on the traverse slide rail 72. The drive motor 78 is connected to the wire winding unit controller 70 so as to be driven in response to a command (traverse position command) from the wire winding unit controller 70.

As described in the foregoing, the wire drawing machine or wire drawing method (system) according to the present example or embodiment uses at least one dancer roller for applying back tension to the wire, at least one wire drawing die for reducing the diameter of the wire, and at least one capstan for winding and transporting the wire without slip to apply front tension to the wire, in which the dancer roller is linearly moved substantially in parallel to a direction of wire drawing of the wire drawing die. Thus, this wire drawing machine or method (system) enables reduction of the width of the wire drawing machine, regardless of the number of wire drawing units to be used therein, whether using a single wire drawing unit or multiple wire drawing units connected in series in a row.

The use of a bent surface (on a housing or the wire drawing machine) having a longitudinally extending base surface and an inclined surface inclined from the base surface provides an advantage of enabling easy adjustment of the height of the wire on the capstan without causing much strain in the wire, and easy placement of the wire over and between the dancer roller, wire drawing die, feed-in guide roller, capstan, separate roller, and feed-out guide roller in a wire drawing unit before starting wire drawing. This advantage of using the bent surface increases in the case where multiple (two or more) wire drawing units are connected to form a wire drawing machine with multiple wire drawing units in one row using the first bent surface, or in two (or more) rows using the first bent surface with a second bent surface having a second base surface and a second inclined surface. It also provides an advantage of easier placement of the wire over and between the multiple wire drawing units before start of wire drawing.

Furthermore, by connecting multiple wire drawing units in a two-row arrangement, upper and lower (upstream and downstream) rows, the width of the wire drawing machine can be further reduced. When using the two-row arrangement, it is preferable to use a surface-indented structure in which the bent surface of the lower row is indented from the bent surface of the upper row, or in other words is closer to rear of the housing of the wire drawing machine, because the surface-indented structure makes easier the operation, before starting the wire drawing, of placing the wire over and between the multiple wire drawing units (over and between the dancer rollers, the wire drawing dies, the capstans, the guide rollers and the like) in both upper and lower rows. In addition, the use of a separate roller near each capstan with the shaft or axis of the separate roller being tilted relative to that of the capstan (more preferably with an elastic coating such as rubber on the capstan) improves the wire drawing or pulling force, thereby making it possible to stably and securely drawing or transporting the wire without slip and with low noise. As a result, it becomes possible to draw and reduce the diameter of the wire into a superfine wire as small as about 10 μm preferably by using multiple wire drawing units or multiple wire drawing processes.

It is to be noted that the present invention is not limited to the above example or embodiment, and various modifications are possible within the spirit and scope of the present invention. For example, all the guide rollers 31, 71, 51, 54, 23, 63 (and so on) can be provided with a strain gauge for detecting tension of the wire and an encoder for detecting the speed of the wire. Furthermore, it is apparent that when multiple wire drawing units are used, not only a single row arrangement or a two-row arrangement of the wire drawing units, but also another multi-row arrangement, such as three-row or four-row, of the wire drawing units can be similarly used. In the case of a multi-row arrangement, it is preferable to use a surface-indented structure described above for each pair of adjacent rows, such that each row of wire drawing units is positioned at a level indented from that at which each preceding row (or each adjacent upper) of wire drawing units is positioned.

INDUSTRIAL APPLICABILITY

The wire drawing machine or system (method) of the present invention can be used to draw not only a metal wire but also a nonmetal wire. In the case of metal wires, this wire drawing machine or system can be used e.g. to draw a gold wire for wire bonding in LSIs (large scale integrated circuits), a cupper wire for a stranded wire, and a stainless: steel wire for a screen-printing mesh, a brass wire for electric discharge machine, a stainless steel fish line, and so on. In the case of nonmetal wires, this wire drawing machine or system can be used e.g. to draw a plastic fiber for optical cable use, and so on.

The present invention has been described using embodiments with reference to the annexed drawings. However, it may be apparent to those ordinarily skilled in the art that various alterations and modifications are possible. Accordingly, it should be interpreted that such alterations and modifications do not fall outside the scope of the present invention, but fall within the scope of the present invention.

The invention claimed is:

1. A wire drawing machine comprising a wire drawing unit which comprises:

a wire drawing die for reducing a diameter of the wire;

a dancer roller for applying back tension to a wire to be drawn, said dancer roller being linearly moved substantially in parallel to a direction of wire drawing of the wire drawing die;

a capstan for winding and transporting the wire without slippage for applying front tension to the wire;

a separate roller adjacent to the capstan, said separate roller having an axis that is slightly tilted relative to an axis of the capstan to allow turns of the wire wound around the capstan to be positioned at different positions on the capstan;

a first guide roller for transporting the wire to the capstan;

a second guide roller for transporting the wire away from the capstan;

a bent surface having a base surface and an inclined surface inclined from the base surface toward a rear of the wire drawing machine, wherein the dancer roller, the wire drawing die, and the guide rollers are placed on the base surface, while the capstan and the separate roller are placed on the inclined surface.

2. A wire drawing machine comprising:

a wire supply unit for supplying a wire to be drawn;

multiple wire drawing units connected to each other for sequentially drawing the wire;

multiple wire winding units for winding the wire from the capstan, each of the wire drawing units comprising a wire drawing die for reducing a diameter of the wire;

a dancer roller for applying back tension to the wire, while the dance roller is being linearly moved substantially in parallel to a direction of wire drawing of the wire drawing die;

a capstan for winding and transporting the wire without slippage and for applying front tension to the wire, a first guide roller for transporting the wire to the capstan, said first guide roller being positioned between the wire drawing die and the capstan;

a second guide roller for transporting the wire away from the capstan;

a separate roller adjacent to the capstan, said separate roller having an axis that is slightly tilted relative to an axis of the capstan to allow turns of the wire wound around the capstan to be positioned at different positions on the capstan; and a bent surface having a base surface and an inclined surface inclined from the base surface toward a rear of the wire drawing machine;

wherein the dancer roller, the wire drawing die, and the guide rollers are placed on the base surface, while the capstan and the separate roller are placed on the inclined surface.

3. The wire drawing machine according to claim 2, wherein the wire drawing units are arranged in at least two rows, such that a lower row in a pair of adjacent rows of wire drawing units is positioned at a level indented from that at which an upper row in the pair is positioned.

* * * * *